United States Patent [19]

Ooi et al.

[11] Patent Number: 5,026,028

[45] Date of Patent: Jun. 25, 1991

[54] APPARATUS FOR CONNECTING STRUT AND HORIZONTAL MEMBER

[75] Inventors: Akihiko Ooi; Toshiaki Hirono, both of Toyama, Japan

[73] Assignee: Yoshida Kogyo, K. K., Tokyo, Japan

[21] Appl. No.: 452,045

[22] Filed: Dec. 18, 1989

[30] Foreign Application Priority Data

Dec. 19, 1988 [JP] Japan ..... 63-163482[U]

[51] Int. Cl.[5] ..... F16B 7/00

[52] U.S. Cl. ..... 256/67; 248/291; 248/251; 403/161

[58] Field of Search ..... 248/286, 291, 251; 256/67, 65; 403/161, 156

[56] References Cited

U.S. PATENT DOCUMENTS

| | | | |
|---|---|---|---|
| 293,673 | 2/1884 | Rogers | 256/65 |
| 895,297 | 8/1908 | Peter | 256/67 |
| 3,529,808 | 9/1970 | Siebers | 256/65 |
| 3,648,982 | 3/1972 | Sabel | 256/65 |
| 3,942,763 | 3/1976 | Helterbrand | 256/65 |
| 4,360,285 | 11/1982 | Magness | 256/65 |
| 4,623,128 | 11/1986 | Dutch | 256/65 |

FOREIGN PATENT DOCUMENTS 194841 12/1987 Japan .

*Primary Examiner*—Ramon O. Ramirez
*Assistant Examiner*—Robert A. Olson
*Attorney, Agent, or Firm*—Hill, Van Santen, Steadman & Simpson

[57] ABSTRACT

An apparatus for connecting at least one horizontal member with a strut comprising: a U-shaped strut bracket having left and right support plates and mounted fixedly on each side face of the strut; a plate-shaped horizontal member bracket having a screw hole at one longitudinal end thereof so as to extend in its lateral direction and supporting thereon the horizontal member to be movable in its longitudinal direction; and a cover member in which one longitudinal end of the horizontal member is inserted, the cover member having an elastically deformable central cover plate, a pair of side cover plate and left and right slit grooves formed between the central plate and the side cover plates into which the support plates are fitted, respectively, so as to connect through screws the cover plate with the strut bracket together with the horizontal member bracket located between the support plates in a manner such that the horizontal member is movable and turnable vertically.

5 Claims, 3 Drawing Sheets

APPARATUS FOR CONNECTING STRUT AND HORIZONTAL MEMBER

BACKGROUND OF THE INVENTION

1. Field of the Invention

This invention relates to an apparatus for connecting a strut for use in a hand rail for stairs and at least one horizontal member such as, for example, upper chord members, lower chord members and top rails or the like.

2. Description of the Prior Art

As an apparatus for connecting a strut and a horizontal member, there is known, for example, the apparatus described in Japanese Laid-Open Utility Model Application NO. SHO 62-194841.

Stating in brief, this prior art apparatus is arranged such that a horizontal member bracket is fixedly secured by means of screws to a strut bracket mounted on each of side faces of a strut, a horizontal member is fitted from above to the horizontal member bracket and fixedly secured to the latter by means of screws, and then a cover member is fitted from above to the connecting portion of the strut bracket and the horizontal member to cover it in such a way that no clearance is created between the strut and the horizontal member.

Such an apparatus for connecting a strut and at least one horizontal member is suitable for use in connecting the strut and the horizontal member at right angles to each other. However, in case the horizontal member is connected to the strut to each other at an angle which is not a right angle, as in the case of hand rails for stairs or the like, this apparatus is not applicable because angular adjustments cannot be made. Furthermore, since a cover member is fitted from above to the strut bracket and the horizontal member, if the angle between the strut and the horizontal member is not a right angle, the horizontal member cannot be connected to the strut.

In particular, as in the case of hand rails for stairs, the work accuracy of stairway is generally poor, and in most cases a deviation occurs between the actual angle between the strut and the horizontal member and the designed value thus requiring adjustments to the angle between the strut and horizontal member to be made at work sites. Therefore, the above-mentioned apparatus is not applicable to such cases.

SUMMARY OF THE INVENTION

The present invention has been made in view of the above-mentioned circumstances in the prior apparatus, and has for its object to provide an apparatus for connecting a strut and at least one horizontal member, which is arranged to solve the above-mentioned problems.

Stating in more detail, the object of the present invention is to provide an apparatus for connecting a strut and at least one horizontal member wherein a cover member is made of an elastic material and has left and right slit grooves formed therein in proximity to the longitudinal ends thereof, each of the slit grooves being configured to allow each of support plates of a strut bracket to be fitted therein, the cover member having formed integrally therewith an elastically deformable central cover plate extending between the slit grooves and adapted to be kept in contact with a mounting plate of the strut bracket, and elastically deformable side cover plates formed substantially in a circular arc shape so as to allow it to keep contact with the side face of the strut.

The above-mentioned construction of the connecting apparatus of the present invention enables the connecting portion of the strut and the horizontal member to be covered by a cover material without forming any clearance between them, and also enable the horizontal member to be turned relative to the strut so that the horizontal member may be connected to the strut at any desired angle.

According to the present invention, there is provided an apparatus for connecting a strut and at least one horizontal member, comprising a U-shaped strut bracket formed by a support plate and left and right support plates and adapted to be mounted on each of side faces of a strut; a horizontal member; a plate shaped horizontal member bracket whose end is arranged to be located between the left and right support plates and adapted to be mounted on the lower portion of the horizontal member, the horizontal member bracket being connected to the left and right support plates by means of screws; and a cover member adapted to be fitted from above to each end of the horizontal member, wherein the cover member has left and right slit grooves formed therein in proximity to the longitudinal ends thereof, a central cover plate formed integrally with the cover member and extending between the left and right slit grooves, and side cover plates located outside the slit grooves, respectively, and formed integrally with the cover member, the left and right slit grooves being configured to allow the left and right support plates to be fitted therein, respectively, the central cover plate being bent in a circular arc shape so as to allow it keep contact with the mounting plate in a manner of being elastically deformable, and each of the side cover plates being formed substantially in a circular arc shape so as to allow it to keep contact with the side face of the strut.

BRIEF DESCRIPTION OF THE DRAWINGS

These and other objects, features and advantages of the present invention will become apparent to those skilled in the art by making reference to the following detailed description and the accompanying drawings in which a preferred embodiment incorporating the principles of the present invention is shown for example only, in which.

DETAILED DESCRIPTION OF THE PREFERRED EMBODIMENTS

Figure 1:
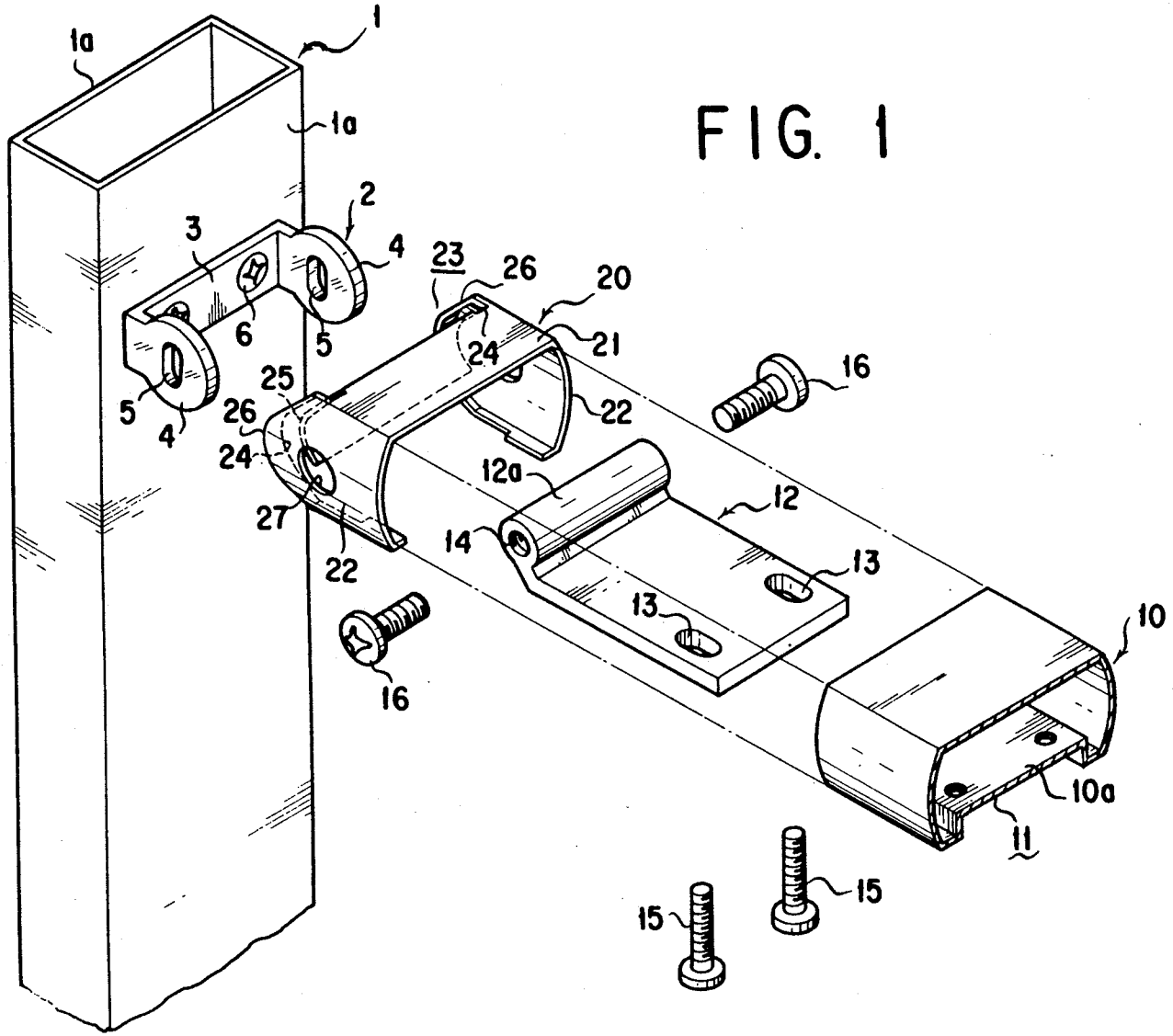
FIG. 1 is an exploded, perspective view of the connecting portion of a strut and a horizontal member.

Referring to the drawings, a strut 1 is comprised of a long, hollow member having a rectangular cross-section and has a strut bracket 2 mounted on each of the side faces 1*a* thereof.

The strut bracket 2 is a U-shaped member comprised of a mounting plate 3 and support plates 4, 4 formed integrally therewith. Each of the support plates 4, 4 is formed substantially in a circular shape and has an elongated hole 5 formed therein, and the mounting plate 3 is mounted on the side face 1*a* of the strut 1 by means of screws 6.

A horizontal member 10 such as for example an upper chord member is a long, hollow member having a rectangular cross-section. The horizontal member 10 has a longitudinally extending downward recess 11 defined by the lower wall 10*a*, and is connected through the intermediary of a horizontal member bracket 12 to the above-mentioned strut bracket 2 in such a way as to be turned freely up and down relative to the latter.

The above-mentioned horizontal member bracket 12 is a plate-shaped member having a pair of elongated, transversely extending through-holes 13, 13 formed in one side thereof, and the other side portion 12*a* formed so as to be bent in a cylindrical shape and which has a screw-threaded hole 14 formed therethrough for insertion of screws 16 to be threadably engaged therewith. This strut bracket 12 is fitted in the downward recess 11 formed in the horizontal member 10 and is mounted on the latter by threadably engaging screws 15 through the elongated holes 13 with the lower wall 10*a* in such a way that the other side portion 12*a* may project outwardly from an end face 10*b* of the horizontal member 10. Subsequently, the other side portion 12*a* is located between the support plates 4, 4 on both sides of the above-mentioned strut bracket 2 and connected to the support plates 4, 4 by threadably engaging screws 16 from the elongated holes 5 in the support plates 4, 4 with the screw-threaded hole 14 thereby connecting the horizontal member bracket 12 to the strut bracket 2 in such a manner that the former may be turned freely up and down relative to the latter.

The cover member 20 is an inverted U-shaped member which is formed by an upper plate 21, and left and right longitudinal plates 22, 22 formed integrally with the upper plate 21 and which extend vertically therefrom. The cover member 20 is adapted to be fitted from above to the horizontal member 10, and has a cover plate 23 formed integrally therewith at the longitudinal end thereof. The cover member 20 is divided by a pair of slit grooves 4, 24 into a central cover plate 25, and left and right side cover plates 26, 26 formed integrally therewith. The cover plate 20 is made of an elastic material. The central cover plate 20 is formed continuously with the upper plate 21 and bent in a circular shape so that it may be elastically deformed. The side cover plates 26, 26 are formed continuously with the left and right longitudinal plates 22, 22, respectively, substantially in a semi-circular arc shape, and project somewhat than the central cover plate 25. In mounting the cover member 20 on the strut bracket 2, the horizontal member 10 and the horizontal member bracket 12, the left and right support plates 4 of the strut bracket 2 are fitted in the pair of slit grooves 24, 24 so that the central cover plate 25 may contact the mounting plate 3 of the strut bracket 2 and the left and right side cover plates 26, 26 may contact the side face 1*a* of the strut 1 and the screws 16 are inserted from through-holes 27 formed in the longitudinal plates 22 and threadably engaged with the screw-threaded hole 14.

Figure 2:
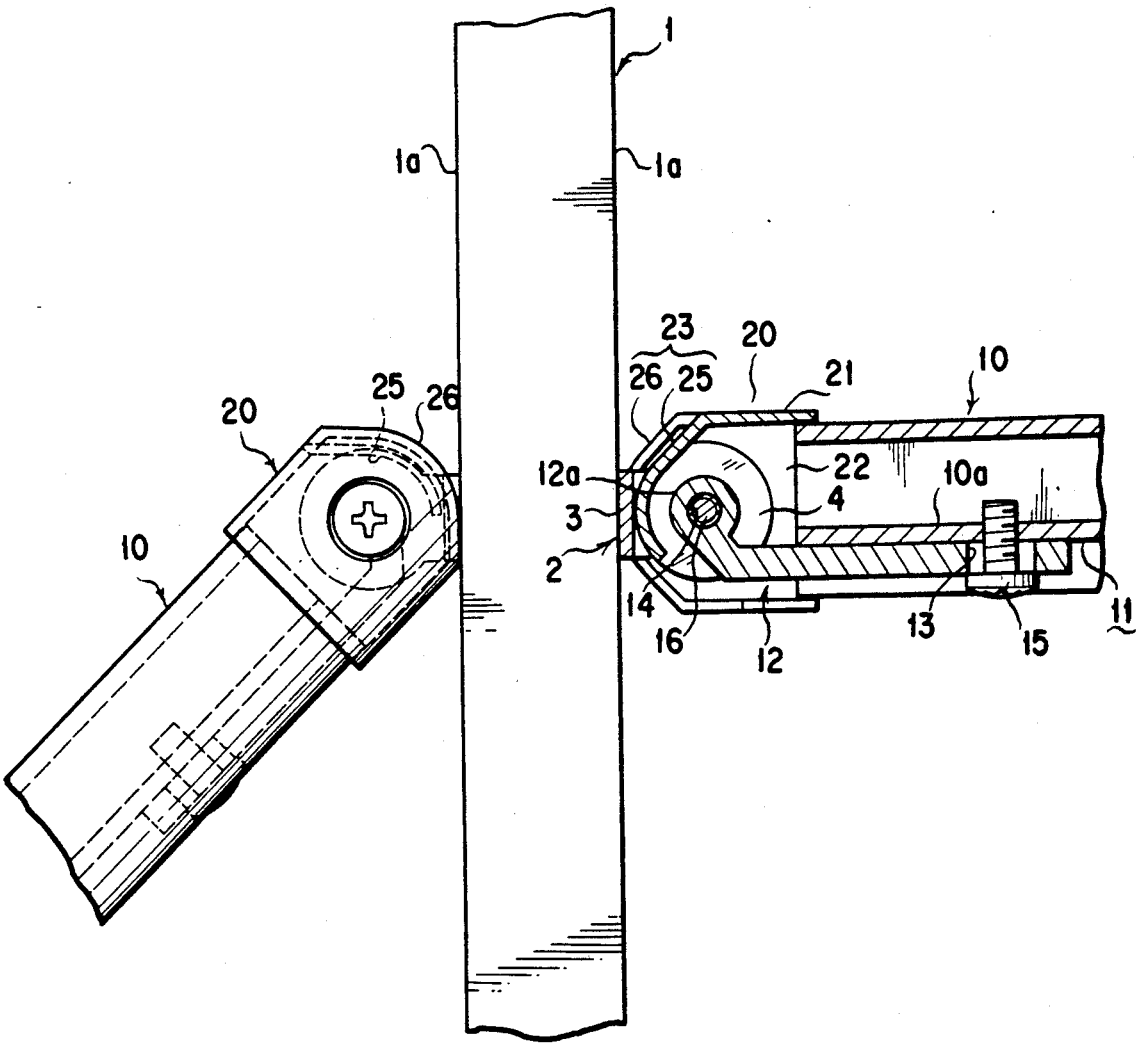
FIG. 2 is a longitudinal sectional view showing the connected condition of the strut and the horizontal member.
Figure 3:
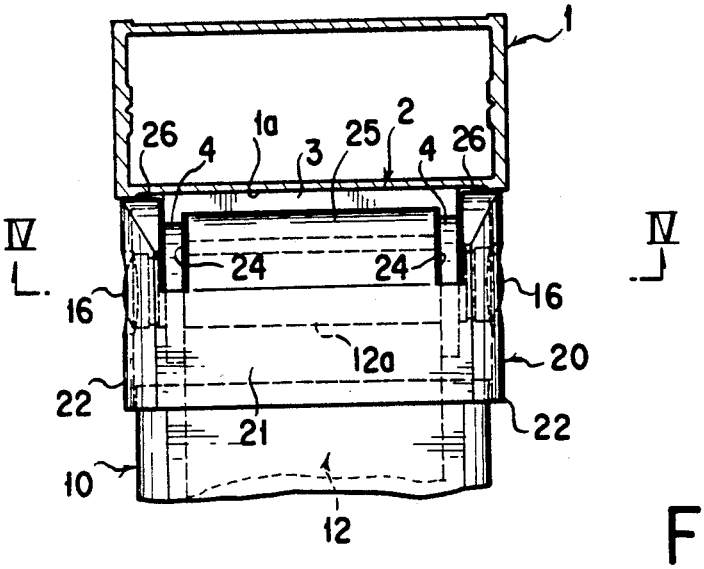
FIG. 3 is a plan view showing the connecting portion.
Figure 4:
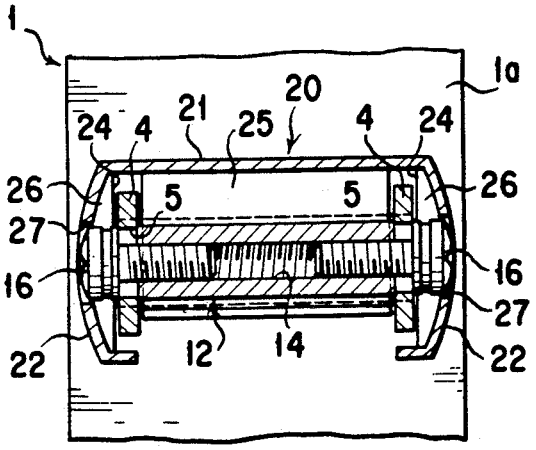
FIG. 4 is a sectional view of the connecting portion taken along line IV—IV in FIG. 3.
Figure 5:
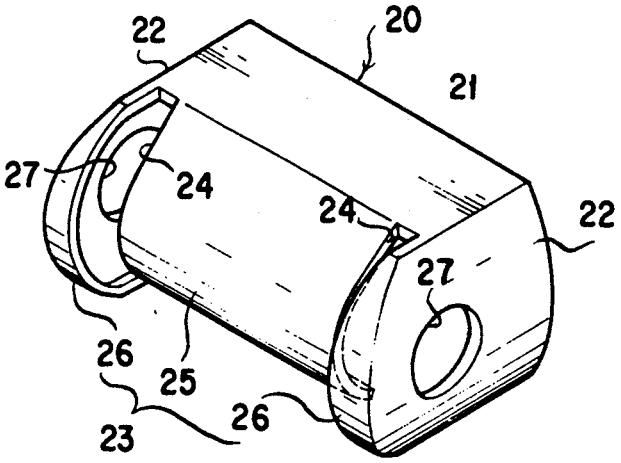
FIG. 5 is a perspective view of a cover member.

Thus, the connecting portion of the strut 1 and the horizontal member 10 can be covered by the cover member 20 without forming any clearance between the strut 1 and the horizontal member 10, and also since the cover member 20 may be turned freely up and down relative to the strut bracket 2, the horizontal member 10 may be connected to the strut 1 at any desired angle such as, for example, a right angle or approximately 45 degrees, as illustrated in FIG. 2.

Further, since each of the support plates 4, 4 of the strut bracket 2 has the vertically elongated hole 5 formed therein, adjustments can be made readily when mounting the components 10, 12 and 20 on the strut bracket 2.

Furthermore, since the cover member 20 can be fitted from above to the horizontal member 10 and longitudinally displaced relative to the latter, and also since the horizontal member bracket 12 can be connected to the horizontal member 10 by means of the screws 16 inserted through the elongated holes 13 and threadably engaged with the lower wall 10 and displaced longitudinally relative to the horizontal member 10, the thermal expansion and contraction of the horizontal member 10 can be absorbed.

According to the connecting apparatus of the present invention, since the support plates 4 of the strut bracket 2 can be fitted in the slit grooves 24, and at the same time, the central cover plate 25 can be brought into contact with the mounting plate 3, and also the side cover plates 26 can be brought into contact with the side surface 1*a* of the strut 1, the connecting portion of the strut 1 and the horizontal member 10 can be covered by the cover member 20 without forming any clearance between them.

Since the above-mentioned central cover plate 25 is elastically deformable and the side cover plates 26 are formed substantially in a circular arc shape, even when the horizontal member 10 is turned up or down relative to the strut 1, it is still possible to keep the central cover plate 25 in contact with the mounting plate 3 and keep the side cover plates 26 in contact with the side face 1*a* of the strut 1 without forming any clearance between the strut 1 and the horizontal member, and the horizontal member 10 can be connected to the strut 1 at any desired angle. Further, even in case there is an error in mounting or in machining or fabrication, the horizontal member 10 can be connected to the strut 1 at any desired angle.

It is to be understood that the foregoing description is merely illustrative of a preferred embodiment of the present invention, and that the scope of the invention is not to be limited thereto, but is to be determined by the scope of the appended claim.

What is claimed is:

1. An apparatus for connecting a strut and at least one horizontal member, comprising a U-shaped strut bracket 2 formed by a mounting plate 3 and left and right support plates 4, 4 and adapted to be mounted on each of side faces 1*a* of a strut; a horizontal member 10; a plate-shaped horizontal member bracket 12 whose end is arranged to be located between the left and right support plates 4, 4 and adapted to be mounted on the lower portion of the horizontal member 10, the horizontal member bracket 12 being connected to the left and right support plates 4, 4 by means of screws 16, 16; and a cover member 20 adapted to be fitted from above to each end of the horizontal member 10, wherein the cover member 20 has left and right slit grooves 24, 24 formed therein in proximity to the longitudinal ends thereof, a central cover plate 25 formed integrally with the cover member 20 and extending between the left and right slit grooves 24, 24, and side cover plates 26, 26 located outside the slit grooves, respectively, and formed integrally with the cover member 20, the left and right slit grooves 24, 24 being configured to allow the left and right support plate 4, 4 to be fitted therein, respectively said central cover plate 25 being bent in a circular arc shape so as to allow it to keep contact with the mounting plate 3 in a manner of being elastically deformable, and each of said side cover plates 26, 26 being formed substantially in a circular arc shape so as to allow it to keep contact with the side face 1*a* of the strut 1.

2. An apparatus for connecting a strut and at least one horizontal member as set forth in claim 1, wherein said cover member 2 is connected through said screws 16, 16 to said strut bracket 2 so as to be turned up or down relative to the strut 1, thereby connecting the horizontal member 10 to the strut 1 at any desired angle.

3. An apparatus for connecting a strut and at least one horizontal member as set forth in claim 1, wherein said left and right support plates 4, 4 of the strut bracket 2 have vertically elongated holes 5, 5, respectively, at their respective center portions so as to be enable the vertical position of said horizontal member 10 to be adjustable.

4. An apparatus for connecting a strut and at least one horizontal member as set forth in claim 1, wherein said horizontal member 10 is fixedly connected to said horizontal member bracket 12 through screws 15, 15 which are penetrated into elongated holes 13, 13 formed in a main plate body of said horizontal member bracket 12 so as to absorb thermal expansion and contraction of the horizontal member 10 and to be anable the horizontal position thereof to be adjustable.

5. An apparatus for connecting a strut and at least one horizontal member in accordance with claim 1, wherein said cover member is composed of an elastic material.

* * * * *